US005312475A

United States Patent [19]

Purnell et al.

[11] Patent Number: 5,312,475

[45] Date of Patent: May 17, 1994

[54] SINTERED MATERIAL

[75] Inventors: Charles G. Purnell; Paritosh Maulik, both of Coventry, United Kingdom

[73] Assignee: Brico Engineering Ltd., West Midland, United Kingdom

[21] Appl. No.: 760,130

[22] Filed: Sep. 16, 1991

[51] Int. Cl.[5] ..... C22C 29/00

[52] U.S. Cl. ..... 75/231; 75/239; 75/240; 75/243; 75/246

[58] Field of Search ..... 75/231, 240, 242, 243, 75/246

[56] References Cited

U.S. PATENT DOCUMENTS

| | | | |
|---|---|---|---|
| 4,583,502 | 4/1986 | Takahashi et al. | 123/90.39 |
| 4,606,768 | 8/1986 | Svilan et al. | 75/246 |
| 4,648,903 | 3/1987 | Ikenoue et al. | 75/230 |
| 4,808,226 | 0/1989 | Adam | 75/246 |
| 4,915,735 | 4/1990 | Motooka | 75/231 |
| 4,964,908 | 10/1990 | Greetham | 75/241 |
| 4,970,049 | 11/1990 | Baker et al. | 419/11 |
| 5,082,433 | 1/1992 | Leithner | 419/11 |
| 5,125,811 | 7/1992 | Amano et al. | 418/179 |

FOREIGN PATENT DOCUMENTS

| | | |
|---|---|---|
| 1339132 | of 1973 | European Pat. Off. . |
| 2087436A | of 1982 | European Pat. Off. . |
| 0130604 | of 1985 | European Pat. Off. . |
| 0266935 | of 1988 | European Pat. Off. . |
| 0312161 | 4/1989 | European Pat. Off. . |
| 61-266555 | 11/1986 | Japan . |

*Primary Examiner*—Donald P. Walsh
*Assistant Examiner*—Ngoclan T. Mai
*Attorney, Agent, or Firm*—Nixon & Vanderhye

[57] ABSTRACT

Sintered materials and a method for their manufacture are described together with products made therefrom, such as piston rings and valve seat inserts for internal combustion engines. The sintered material comprises a porous matrix with a composition lying in the range expressed in wt % of 8 to 12 chromium, 0.5 to 3 molybdenum, up to 1.5 vanadium, 0.2 to 1.5 carbon, other impurities 2 max., up to 1 manganese sulphide, optionally up to 5 molybdenum disulphide, balance iron, the matrix having a uniform dispersion of submicroscopic particles of molybdenum rich carbides which render the material resistant to thermal softening.

24 Claims, 5 Drawing Sheets

SINTERED MATERIAL

BACKGROUND OF THE INVENTION

The present invention relates to sintered materials, a method for their manufacture, and products made therefrom.

Some components such as valve seat inserts and piston rings for internal combustion engines and compressors, for example, may be produced via a powder metallurgy (PM) route. Such PM components are generally made from an iron based powder material.

One such known material containing about 12 wt % of chromium, 6 wt % of copper, 1 wt % of carbon, 0.4 wt % of molybdenum, and the balance iron is described in GB 1,339,132. Similar compositions are found in GB 2,087,436.

These prior art materials employ additions of elemental molybdenum powder with or without molybdenum disulphide powder to the already prealloyed iron-chromium alloy powder.

Molybdenum is beneficial from the point of view of improving hardenability and, potentially, the resistance to thermal softening of the sintered material. However, the use of elemental molybdenum powder is disadvantageous in that it is an inefficient way of using an expensive material and in that the metallurgical microstructure so produced is not the optimum attainable, since the sub-microscopic carbides that give resistance to thermal softening in the ferrous lattice cannot be uniformly dispersed due to the limited diffusion of molybdenum into the matrix lattice during sintering.

Molybdenum, when added as an elemental powder, forms coarse particles of molybdenum rich carbide in the matrix so that only a small proportion of molybdenum dissolves in the matrix, thus the effect on hardenability is small and there is little effect on the heat resistant properties of the material unless the sintering temperature is raised well above 1200 degrees Centigrade.

Where molybdenum disulphide is added, this can react with chromium in the matrix to form chromium sulphide, freeing molybdenum into the material matrix to locally endow the matrix with an improved degree of heat resistance. Not all the molybdenum disulphide reacts in this manner and some of it remains to provide self-lubricating properties.

Molybdenum, more than most other carbide forming elements, is also beneficial from the point of view of the microstructure in the formation of molybdenum carbide. There is a large difference between the atomic weight of molybdenum and carbon (96 and 12, respectively). 1 wt % of molybdenum requires only about 0.06 wt % of carbon to form the stoicheiometric molybdenum carbide composition. Therefore, theoretically, a desired degree of hardening and thermal resistance can be achieved from a very low carbon content.

WO 90/06198 describes the manufacture of precision moulded components in iron based powder materials. This document mentions some of the advantages to be gained from prealloying the molybdenum with the iron but specifies that other alloying additions such as manganese, chromium, silicon, copper, nickel and aluminium must be maintained below a maximum level not exceeding 0.4 wt % in total in the prealloyed powder. It is further stated that if this figure is exceeded a severe decrease in the compressibility of the powder results, which effectively means final components having lower densities and, therefore, inferior properties.

BRIEF SUMMARY OF IN THE INVENTION

We have found that components made from materials having good hardenability and needing hot wear resistance such as valve seat inserts and/or piston rings may be produced from an iron based powder having prealloyed molybdenum and a, relatively, very high chromium content conferring corrosion resistance compared to the prior art and still produce improved mechanical and physical properties.

According to a first aspect of the present invention, there is provided a sintered ferrous-based material, the sintered material having a porous martensitic matrix with a composition lying in the range expressed in wt % of 8 to 12 chromium, 0.5 to 3 molybdenum, up to 1.5 vanadium, 0.2 to 1.5 carbon, other impurities 2 max., and the balance iron, the matrix having a substantially uniform dispersion of submicroscopic particles of molybdenum rich carbides.

In a material in accordance with the invention, the uniform dispersion of submicroscopic particles of molybdenum rich carbides derives from the use of a powder wherein all of the molybdenum is in "elemental" form, as distinct from added compounds, such as molybdenum disulphide, the molybdenum being prealloyed into the iron powder matrix during the manufacture of the powder.

Preferably, the molybdenum content may lie in the range from 1 to 3 wt %, most preferably in the range 1.5 to 2.5 wt %.

Preferably, the chromium content may lie in the range from 9 to 11 wt %.

The other impurities, which may primarily comprise nickel, manganese and silicon, may be present up to 2 wt % maximum.

The carbon may be present in the range 0.2 to 1.2 wt %.

In the final heat-treated form, the matrix consists of tempered martensite, with grain boundary carbides to an extent partly dependent upon the final carbon content.

The composition may also contain up to 1 wt % of manganese sulphide and/or up to 5 wt % of molybdenum disulphide.

The sintered material of the present invention may be infiltrated either with copper or a copper based alloy in order to fill the residual porosity. Alternatively, the material may be uninfiltrated, in which case there may be an addition of 2 to 6 wt % of copper added to the initial powder mix as the elemental powder to assist sintering and material properties. Where the material is infiltrated, this may be achieved either sequentially by separate sintering and infiltrating operations or preferably, simultaneously by a combined sintering and infiltration step.

The sintered material according to the invention may be considered to fall into two distinct classes which may be used for different applications.

In a first preferred range of compositions of the invention, the carbon content lies in the range from 0.2 to 0.6 wt %, this material being primarily intended for internal combustion (IC) engine piston ring or sealing ring applications. Piston rings are almost always of small cross sectional area and more recently of thickness reduced towards 1 mm. Powder mixes having several different constituent powders which possess varying densities, particle sizes and shapes, tend to readily demix through segregation. This defect worsens as the powders are handled by being transported in drums, vibrated in die powder hoppers and in the dies themselves. This leads to inhomogeneity in the resulting sintered material which, when in the form of a low cross-sectional component such as a piston ring, gives exaggerated variations in the material mechanical and physical properties around the ring.

In the material of the present invention, the carbon is added to the mixture as a separate powder but, since the added content is low, it has a relatively small effect on powder inhomogeneity. Much more important is the fact that because the molybdenum is prealloyed into the base powder and is present in a homogeneous form in the iron, it is able to utilise efficiently low levels of admixed carbon to form molybdenum rich carbides. In prior art powders, the molybdenum was added as elemental powder of relatively large particle size and the particles of molybdenum rich carbide formed were of the order of 10 to 100 micrometres in diameter. These particles were too big to endow the material with any significantly improved heat resistance, being separate from the matrix lattice, and large, so that the material properties around a piston ring varied considerably. In the material of the present invention, the molybdenum rich carbides formed in the final structure, following sintering and heat-treatment are sub-microscopic, being less than 1 micron in size, and are dispersed in the lattice, which promotes uniformity of properties and imparts greatly improved heat resistance to the material. Since the molybdenum is prealloyed in the iron-chromium matrix, the hardenability of the matrix is greatly improved for any given overall molybdenum content.

It is highly desirable in a piston ring material to have uniform elastic properties around the ring. This desirable objective is facilitated when the molybdenum is in prealloyed form and when there are lower amounts of powders such as carbon added to the mixture.

Internal combustion engine piston rings produced by a powder metallurgy route, may assume increasing importance in the future due to legislation in various countries relating to "flexible fuelling", which requires engines to be able to operate using fuels which have combustion byproducts which are highly corrosive. Conventional piston rings, made by a casting route or bending from wire, will require to be either chromium or nickel plated or to be highly alloyed to survive. The material of the present invention is resistant to thermal softening and would resist corrosion under flexible fuelling conditions due to the high intrinsic chromium level and is amenable to surface hardening processes. The advantages of a PM material for IC piston rings, wherein the porosity and Elastic Modulus can be controlled through pressed density, are available to this ring material. Furthermore, the prealloyed molybdenum permits surface hardening techniques to be used without distortion or loss of dimensional control for such fragile and slender components because of the material's resistance to thermal relaxation of elastic properties.

In a second preferred range of material compositions, the carbon content may lie in the range from 0.6 to 1.5 wt %, this material being primarily intended for use in valve seat inserts for internal combustion engines. In this application, because of increased surface temperatures and stresses, increased hardness, especially hot-hardness and heat resistance are required, compared with a piston ring, therefore, an enhanced carbon level is necessary.

According to a second aspect of the present invention, the prealloyed powder and carbon may be mixed with a high compressibility iron powder as a dilutent. Up to 60 wt % of the final product of the diluent iron powder may be added at the powder mixing stage. A suitable, commercially available, dilutent iron powder may be Atomet AT 1001 (trade mark), for example, containing nominally 0.2% of manganese.

In the diluted material, the sintered and heat-treated material microstructure comprises a reticular structure with one phase having a martensitic structure as described above in the first aspect of the invention, and a second phase of pearlite with some residual ferrite regions, the transition zones between the two phases comprising tempered martensite/bainite.

According to a third aspect of the present invention, there is provided a method of making a sintered material, the method comprising the steps of making a prealloyed powder having a composition lying in the range expressed in wt %: 8 to 12 chromium, 0.5 to 3 molybdenum, 1.5 max vanadium, 0.2 max carbon, 2 max other impurities, and the balance iron; mixing the prealloyed powder with up to 1 wt % manganese sulphide, optionally up to 5 wt % molybdenum disulphide, and up to 60 wt % of a high compressibility iron powder, the total carbon content of the powder mix being up to 1.5 wt %; pressing the powder to a desired density; and sintering the pressed powder.

From 2 to 6 wt % admixed copper, powder may also be included in the powder mix as a sintering aid. Alternatively, sintered material made by a method, according to the invention, may be infiltrated with copper or a copper alloy in which case the method may include the additional step of infiltration, which may be either after, or simultaneously with, the sintering step. In this case, the admixed copper may be omitted.

The method may also include the steps of cryogenically treating and tempering the sintered material.

In order that the present invention may be more fully understood, the compositions of example materials are listed in a Table below, materials A, B, H, I, and L being prior art materials included for comparison purposes. The accompanying Figures illustrate the properties of some of the materials included in the Table.

In the Table, the first column gives an identifying code, prior art materials being marked with a "*", and "infil." in column 3 standing for "infiltrated". Percentages given in the last column are weight percentages based on the weight of the final product, e.g., the previous columns total 100% and based on this a further percentage of iron given in the last column is used as dilutent.

| Alloy Code | Fe | Cu wt % or infil. | MnS wt % | $MoS_2$ wt % | V wt % prealloy | C wt % graphite | Mo wt % powder | Mo wt % prealloy | Cr wt % prealloy | Diluted with Fe % |
|---|---|---|---|---|---|---|---|---|---|---|
| A* | Bal. | 6 | — | — | — | 1.0 | 0.4 | — | 12 | — |
| B* | Bal. | 6 | — | 3.5 | — | 1.0 | 0.4 | — | 12 | — |
| C | Bal. | 4 | 0.5 | — | — | 1.0 | — | 2.0 | 10 | — |
| D | Bal. | 4 | 0.5 | — | 1.0 | 1.0 | — | 2.0 | 10 | — |
| E | Bal. | Infil. | — | — | — | 1.0 | — | 2.0 | 10 | — |
| F | Bal. | Infil. | — | — | — | 1.0 | — | 2.0 | 10 | 25 |
| G | Bal. | Infil. | — | — | — | 1.0 | — | 2.0 | 10 | 50 |
| H* | Bal. | Infil. | — | — | — | 1.0 | 0.4 | — | 12 | — |
| I* | Bal. | 4 | 0.5 | — | — | 0.5 | 2.0 | — | 12 | — |
| J | Bal. | 4 | 0.5 | — | — | 0.5 | — | 2.0 | 10 | — |
| K | Bal. | 4 | 0.5 | — | — | 0.45 | — | 2.0 | 10 | — |
| L* | Bal. | 4 | 0.5 | — | — | 0.45 | 2.0 | — | 12 | — |
| M | Bal. | 6 | — | 3.5 | — | 1.0 | — | 2.0 | 10 | — |

DETAILED DESCRIPTION OF PREFERRED EMBODIMENTS OF THE INVENTION

In the sintered materials which were produced, all of the powders were compacted at 770 MPa and sintered at 1100 degrees C in a protective atmosphere. Post sintering thermal treatments were also applied.

Where the materials were infiltrated, this was carried out during sintering at 1100 degrees C and was followed by thermal treatment.

Where the alloys are diluted with iron powder, Atomet AT 1001 (trade mark) was used as the dilutent iron powder.

Figure 1:
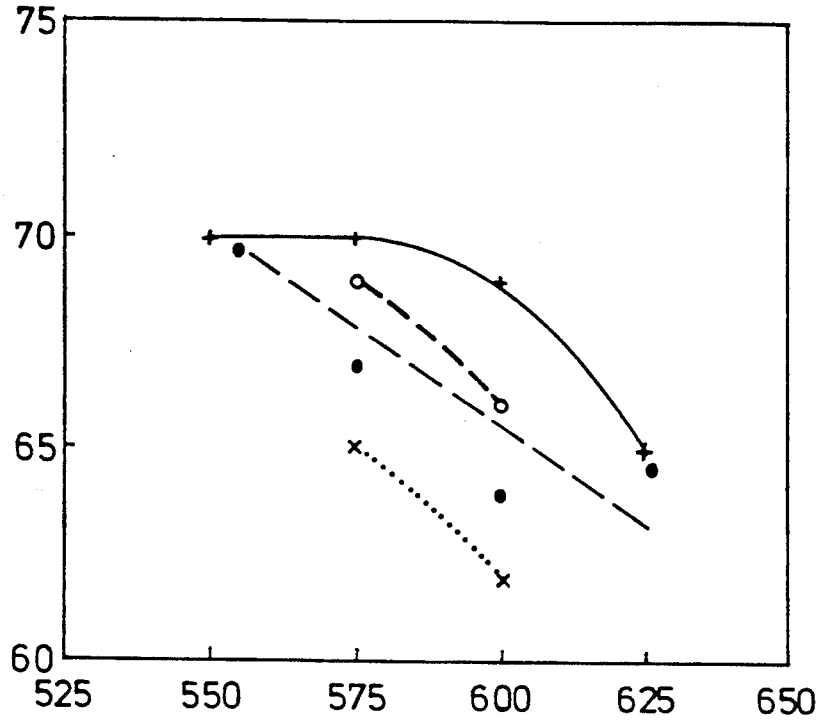
FIG. 1 shows a graph of room temperature hardness (y axis) against tempering temperature (degrees centrigrade), for uninfiltrated, sintered materials C and D, according to the present invention, together with known materials, A and B.

Reference is now made to the graphs in the Figures. FIG. 1 shows plots of as tempered hardness (HRA) against tempering temperature in degrees centigrade (x axis) for materials A (x), B (o), C (+), and D (.). It can be seen that the as tempered hardness of the prealloyed molybdenum bearing alloy C, is highest. Although alloy D, prealloyed with molybdenum and vanadium shows somewhat lower tempered hardness, compared to alloy B, the resistance to thermal softening of the former is greater as can be seen from FIG. 2 in which plots of hot hardness (HR30N) against temperature are shown for the same materials as in FIG. 1. The hot-hardness of the alloys of the present invention clearly exceeds those of the prior art alloys described in GB 1,339,132 and GB 2,087,436 and exemplified in alloys A and B.

Figure 2:
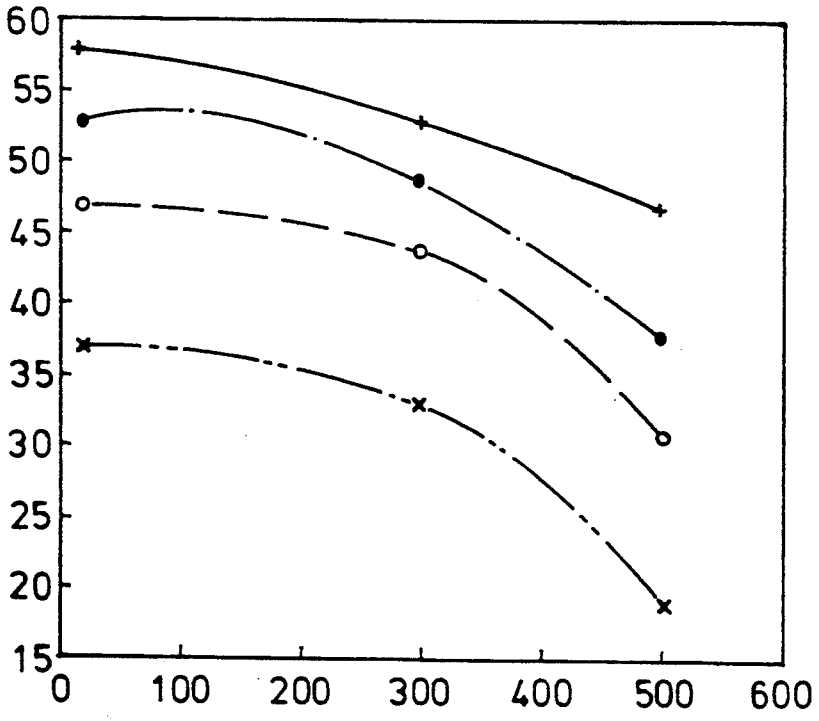
FIG. 2 shows curves of hot-hardness (y axis) against test temperature (degrees centigrade) for the materials of FIG. 1, after tempering at a common temperature.
Figure 3:
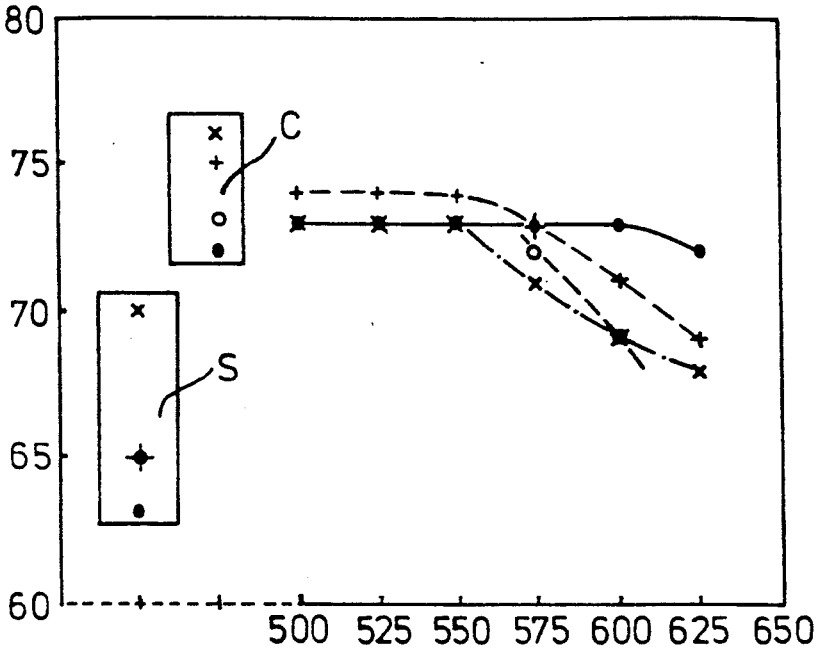
FIG. 3 shows room temperature hardness (y axis) against tempering temperature for infiltrated materials, E, F, G, according to the present invention, and a known material, H.
Figure 4:
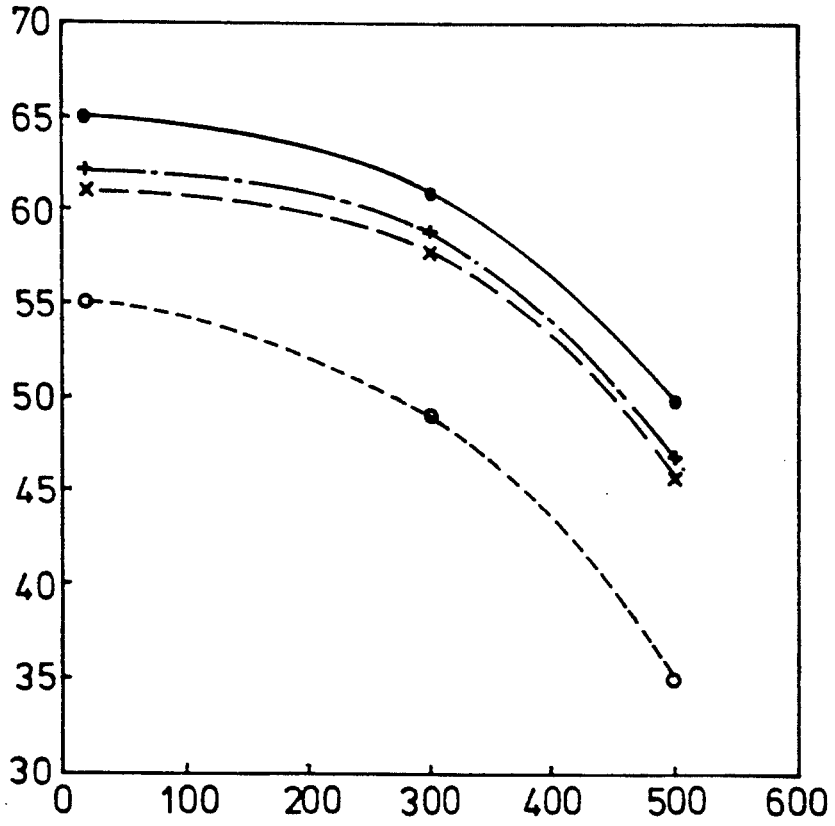
FIG. 4 shows hot-hardness curves similar to FIG. 2 for the materials of FIG. 3, after tempering at a common temperature.

The beneficial effect of prealloyed molybdenum is seen in FIGS. 3 and 4. FIG. 3 shows a plot of room temperature hardness against temperature at different stages of their processing for materials E (.), F (+), G (x), and H (o). In the box marked S, the hardnesses following sintering are shown, in the box marked C, the hardnesses after subsequent cryogenic treatment are shown, and the curves indicate hardnesses measured at room temperature after different tempering temperatures. FIG. 4 is similar to FIG. 2 but relates to the materials shown in FIG. 3. The hardness of the molybdenum prealloyed powder, diluted with 50% iron powder, alloy G, is comparable to that of the alloy made with the elemental molybdenum addition, alloy H, which is undiluted with iron powder. Both of these alloys were infiltrated. Out of all the four alloys examined in the infiltrated condition, the alloy made with elemental molybdenum addition, showed the lowest resistance to thermal softening. Thus, the hot-hardness of the present alloys clearly exceeds those of prior art alloys as exemplified in alloy H.

Figure 5:
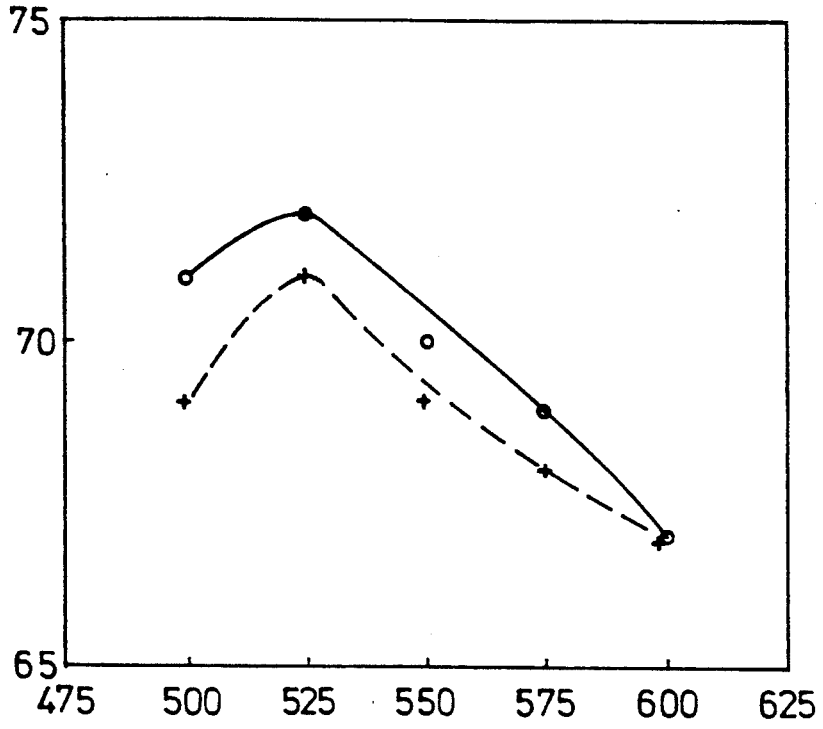
FIG. 5 shows room temperature hardness (y axis) against tempering temperature and illustrates the effect of prealloyed and elemental Molybdenum, material J being according to the present invention, and material I being a prior art material which includes admixed elemental molybdenum powder.
Figure 6:
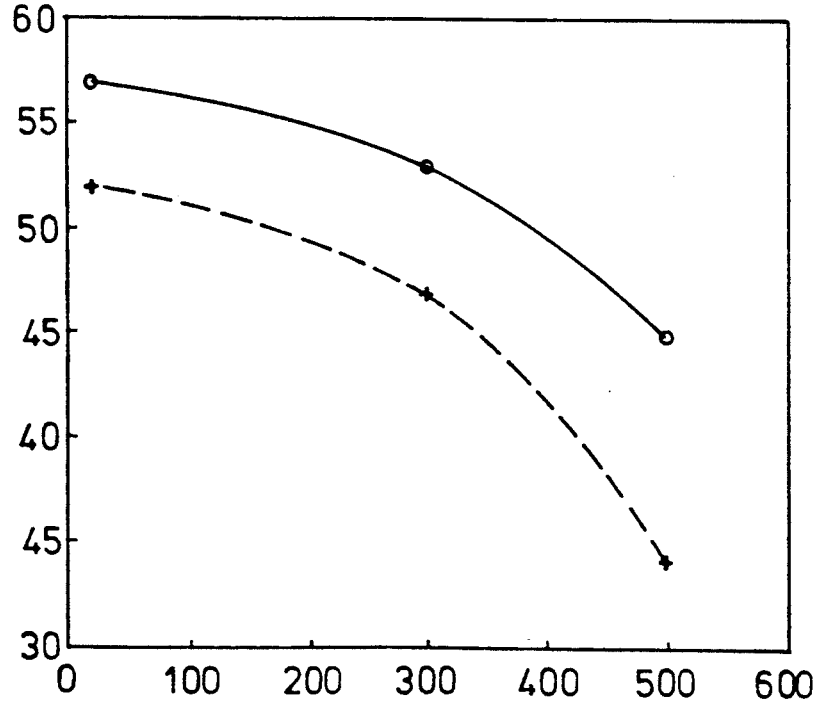
FIG. 6 shows hot-hardness (y axis) against test temperature and illustrates the effect of prealloyed and elemental Molybdenum on hot-hardness, of the materials of FIG. 5 after a common tempering treatment.

In order to demonstrate that the lower properties of the elemental molybdenum added alloys are due to incomplete dissolution of molybdenum in the matrix, resulting in undesirable distribution of molybdenum carbides, and not due to the overall level of molybdenum, two alloys I and J were prepared. Both of these contain about 2% molybdenum powder addition, whereas alloy J, was made from a similar base powder, but prealloyed with molybdenum. FIGS. 5 and 6, which are similar to FIGS. 1 and 2 repectively but relate to alloys I (+) and J (o), show that the alloy made by the pre-alloyed route, shows improved properties compared to that of the elemental addition route. Additionally, the presence of large discrete molybdenum rich particles/carbides in the microstructure of the alloy I, indicate the incomplete dissolution of molybdenum in the matrix; no such molybdenum rich particles were observed in the alloy J. In this material (alloy J), the majority of the molybdenum forms fine secondary carbides which are finer than the resolution power of the optical microscope.

Figure 7:
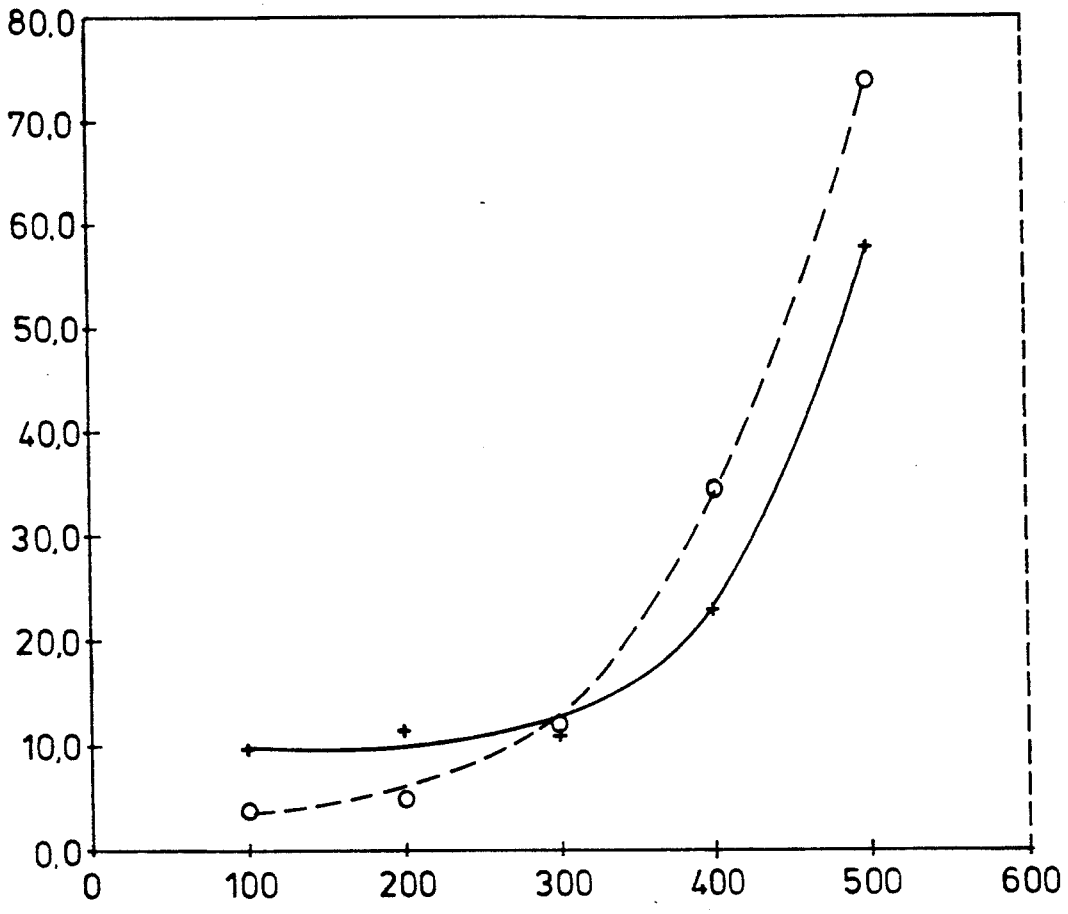
FIG. 7 shows drop in load to close a gap in a ring (percentage, y axis) against loading temperature and illustrates the results of a heat-collapse test on materials K and L which are intended as ring materials, material K being according to the invention and material L being a prior art material.

FIG. 7 shows a plot of the drop in load required to close a gap in a ring as a percentage (y axis) against temperature in degrees centigrade at which piston rings made from the alloys K(+) and L(o) were subjected to a given amount of elastic loading for 16 hours. Although the prior art alloy I performs marginally better at temperatures below about 300 degrees, once the usual working temperatures of an internal combustion engine are reached, the alloy K can be seen to be considerably superior for the higher temperatures.

Figure 8:
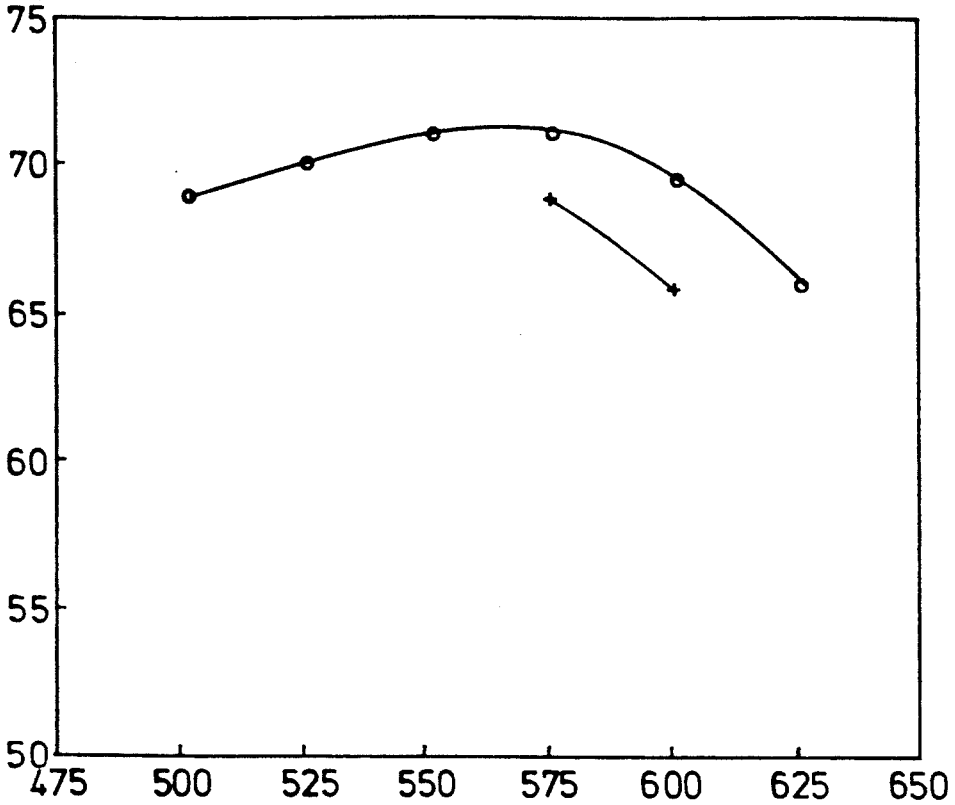
FIG. 8 is similar to FIG. 1 but shows material M and known material B.
Figure 9:
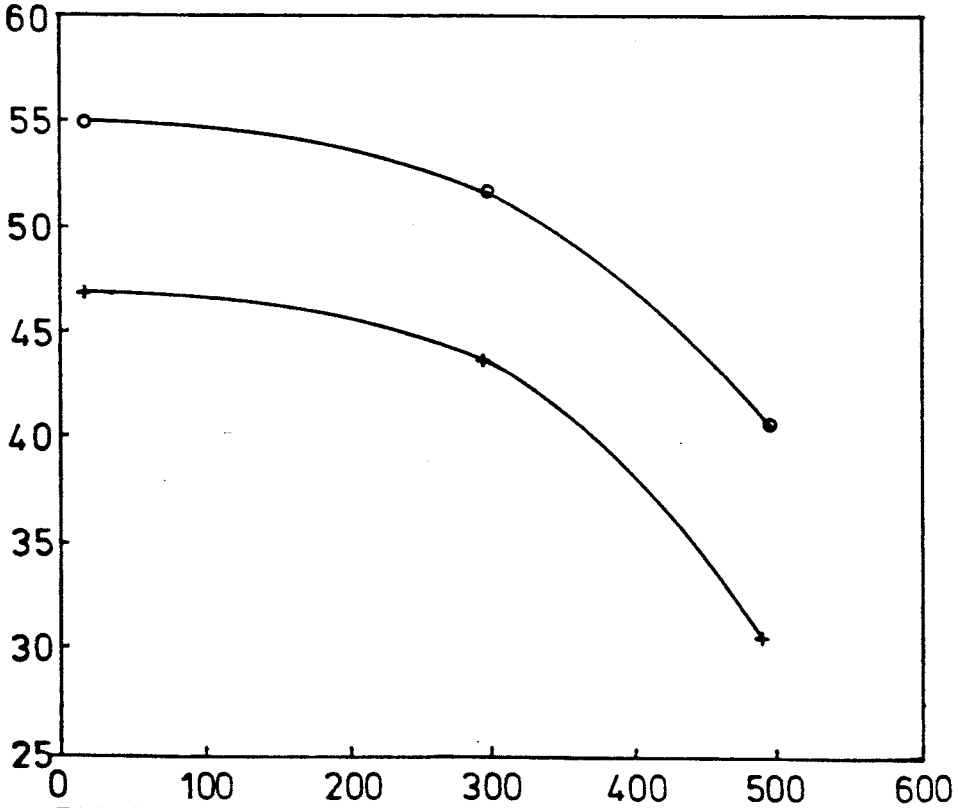
FIG. 9 is similar to FIG. 2 but shows material M and known material B.

FIGS. 8 and 9 compare alloy M (o) with the analagous alloy B (+) which has already been illustrated in FIGS. 1 and 2. It can be seen that the alloy M has considerably greater hardnesses.

We claim:

1. A sintered ferrous material which has a porous molybdenum/chrominum martensitic matrix formed from a single alloy having a composition expressed in weight percent consisting essentially of 8–12 chromium, 0.5–3 molybdenum, up to 1.5 vanadium, 0.2–1.5 carbon, other impurities 2 max, and the balance iron, the matrix having sub-microscopic molybdenum-rich carbides less than 1 micron in size substantially uniformly distributed therein.

2. A sintered material according to claim 1, wherein the molybdenum content lies in the range from 1.5 to 2.5 wt %.

3. A sintered material according to claim 1, wherein the chromium content lies in the range from 9 to 11 wt %.

4. A sintered material according to claim 1, wherein the composition also contains up to 1 wt % of manganese sulphide.

5. A sintered material according to claim 1, wherein the composition also contains 2 to 6 wt % of copper.

6. A sintered material according to claim 1, wherein the carbon content lies in the range from 0.2 to 0.6 wt %.

7. A sintered material according to claim 1, wherein the carbon content lies in the range from 0.6 to 1.5 wt %.

8. A piston or sealing ring made of a sintered ferrous material according to claim 6.

9. A valve seat insert for an internal combustion engine made of a sintered ferrous material according to claim 7.

10. A sintered ferrous material which has a porous molybdenum/chromium martensitic matrix formed from a single alloy having a composition expressed in weight percent consisting essentially of 8–12 chromium, 0.5–3 molybdenum, up to 1.5 vanadium, 0.2–1.5 carbon, other impurities 2 max, and the balance iron, the matrix having sub-microscopic molybdenum rich carbides less than 1 micron in size substantially uniformly distributed therein, the matrix being infiltrated with copper or a copper based alloy.

11. A sintered material according to claim 10, wherein the molybdenum content lies in the range from 1.5 to 2.5 wt %.

12. A sintered material according to claim 10, wherein the chromium content lies in the range from 9 to 11 wt %.

13. A sintered material according to claim 10, wherein the composition also contains up to 1 wt % of manganese sulphide.

14. A sintered material according to claim 10, wherein the carbon content lies in the range from 0.6 to 1.5 wt %.

15. A valve seat insert for an internal combustion engine made of a sintered ferrous material according to claim 14.

16. A sintered ferrous material which has a porous matrix having a recticular structure of essentially two phases, a first phase formed from an alloy having a composition expressed in weight percent consisting essentially of 8–12 chromium, 0.5–3 molybdenum, up to 1.5 vanadium, 0.2–1.5 carbon, other impurities 2 , max, and the balance iron, the first phase having sub-microscopic molybdenum-rich carbides less than 1 micron, in size substantially uniformly distributed therein, and a second phase of pearlite with some residual ferrite regions formed from a relatively pure iron powder with carbon addition, the two phases having transition zones therebetween, the transition zones comprising martensite and bainite.

17. A sintered material according to claim 16, wherein the molybdenum content of the first phase lies in the range from 1.5 to 2.5 wt %.

18. A sintered material according to claim 16, wherein the chromium content of the first phase lies in the range from 9 to 11 wt %.

19. A sintered material according to claim 16, wherein the composition contains up to 1 wt % of manganese sulphide.

20. A sintered material according to claim 16, wherein the composition also contains 2 to 6 wt % of copper.

21. A sintered material according to claim 16, wherein the carbon content lies in the range from 0.2 to 0.6 wt %.

22. A sintered material according to claim 16 wherein the carbon content lies in the range from 0.6 to 1.5 wt %.

23. A piston or sealing ring made of a sintered ferrous material according to claim 21.

24. A valve seat insert for an internal combustion engine made of a sintered ferrous material according to claim 22.

* * * * *